United States Patent [19]

Nelson et al.

[11] 4,260,017

[45] Apr. 7, 1981

[54] CEMENTING COLLAR AND METHOD OF OPERATION

[75] Inventors: Wayne F. Nelson; Paul A. Weiss, both of Wichita Falls, Tex.

[73] Assignee: The Dow Chemical Company, Midland, Mich.

[21] Appl. No.: 93,647

[22] Filed: Nov. 13, 1979

[51] Int. Cl.[3] ..... E21B 33/14; E21B 33/16; E21B 34/14

[52] U.S. Cl. ..... 166/154; 166/289; 166/318

[58] Field of Search ..... 166/154, 285, 289, 318

[56] References Cited

U.S. PATENT DOCUMENTS

| | | | |
|---|---|---|---|
| 2,249,511 | 7/1941 | Westall | 166/154 X |
| 3,131,767 | 5/1964 | Chancellor et al. | 166/289 X |
| 3,464,493 | 9/1969 | Chancellor et al. | 166/285 |
| 3,633,671 | 1/1972 | Nelson | 166/318 X |
| 3,789,926 | 2/1974 | Henley et al. | 166/154 X |
| 4,176,717 | 12/1979 | Hix | 166/289 |

*Primary Examiner*—James A. Leppink
*Assistant Examiner*—George A. Suchfield
*Attorney, Agent, or Firm*—V. Dean Clausen

[57] ABSTRACT

The cementing collar described herein is designed primarily for cementing operations in oil or gas wells. The basic assembly includes a collar, an outer sleeve slidable in the collar, and an inner sleeve slidable in the outer sleeve. The collar and outer sleeve each have cementing ports therein. When the assembly is being run into the well casing, the collar and both sleeves are secured by shear pins in a position such that the cementing ports are closed. To open the cementing ports a trip bomb is dropped into the casing to engage a seat inside the outer sleeve. This causes the pins to shear and permits the outer sleeve to move down to a position in which the sleeve ports line up with the collar port. After cementing has been completed, a plug is flowed down the casing to engage the inner sleeve. Fluid pressure is applied behind the plug to shear the pins a second time. This moves the outer sleeve further down to a position in which the cementing ports are again closed.

8 Claims, 5 Drawing Figures

CEMENTING COLLAR AND METHOD OF OPERATION

BACKGROUND OF THE INVENTION

When boreholes are drilled to recover oil or gas the well casing dropped into the hole is usually cemented at the lower end of the hole, and at other locations above the lower end. In cementing the lower end of the casing, usually called primary cementing, a cement slurry is passed down through the casing and up into the annular space between the casing and the borehole. Cementing above the lower end of the borehole is usually done later than the primary cementing job, that is, during the productive life of the well. These later operations are usually referred to as secondary cementing, or stage cementing.

In a stage cementing operation, as the name suggests, the borehole annulus is cemented in separate stages, beginning above the primary cementing job and working up the borehole. Special tools have been developed for use in stage cementing to make the operation more convenient and to save on the amount of cement required. Most of these tools have an upper sleeve and a lower sleeve, which are slidable inside a collar having cement ports therein. In the "running in" position both sleeves are fastened to the collar by shear pins. In this position the cementing ports are closed off by the sleeves. To commence the cementing operation, a plug is flowed down the casing to seat on the lower sleeve. Fluid pressure is then applied behind the plug to shear the pins holding the lower sleeve and thus move the lower sleeve down to a point where the cementing ports are uncovered. Following completion of cementing, a second plug is seated on the upper sleeve and fluid pressure applied behind the plug shears the pins holding the upper sleeve. This allows the upper sleeve to move down and close off the cementing ports.

Stage cementing tools of the type described above frequently have operating problems. For example, when the second plug (the closing plug) seats on the upper sleeve several inches of cement slurry are trapped between the second plug and the first plug (the opening plug), which remains seated in the lower sleeve. When the upper sleeve moves downwardly, therefore, it must work against the trapped cement. Because of this obstacle, the amount of fluid pressure required to move the upper sleeve to its closed position can sometimes be very near to the burst pressure rating for the well casing.

SUMMARY OF THE INVENTION

The collar assembly of this invention is designed for cementing a well casing in a borehole. Basic parts of the collar assembly include a collar member, an outer sleeve, and an inner sleeve. The collar member, which connects into the well casing has one or more port openings through the collar wall. The outer sleeve is slidably positioned inside the collar member and it also has one or more port openings through the sleeve wall. The inner sleeve is positioned inside the outer sleeve and is moveable within the outer sleeve. Prior to the cementing operation, the outer sleeve is secured to the collar member and the inner sleeve to the outer sleeve by a shear means. A seat member is fastened to the inside of the outer sleeve.

To commence the cementing operation, a weighted trip member is dropped through the inner sleeve to engage the seat member on the outer sleeve. When the trip member makes contact with the seat member, the resulting force causes the shear means to shear loose. This allows the outer sleeve to move to a first position in which the collar ports and sleeve ports are in direct alignment. A cement slurry is then pumped down through the well casing and into the borehole annulus through the port openings. When cementing is completed, a cementing plug is dropped behind the cement slurry and this plug engages the top edge of the inner sleeve. Fluid pressure is then applied against the cementing plug to cause the shear means to shear a second time. This allows the outer sleeve to move to a second position in which the ports in the outer sleeve move past the ports in the collar member.

DESCRIPTION OF PREFERRED EMBODIMENTS

Figure 1:
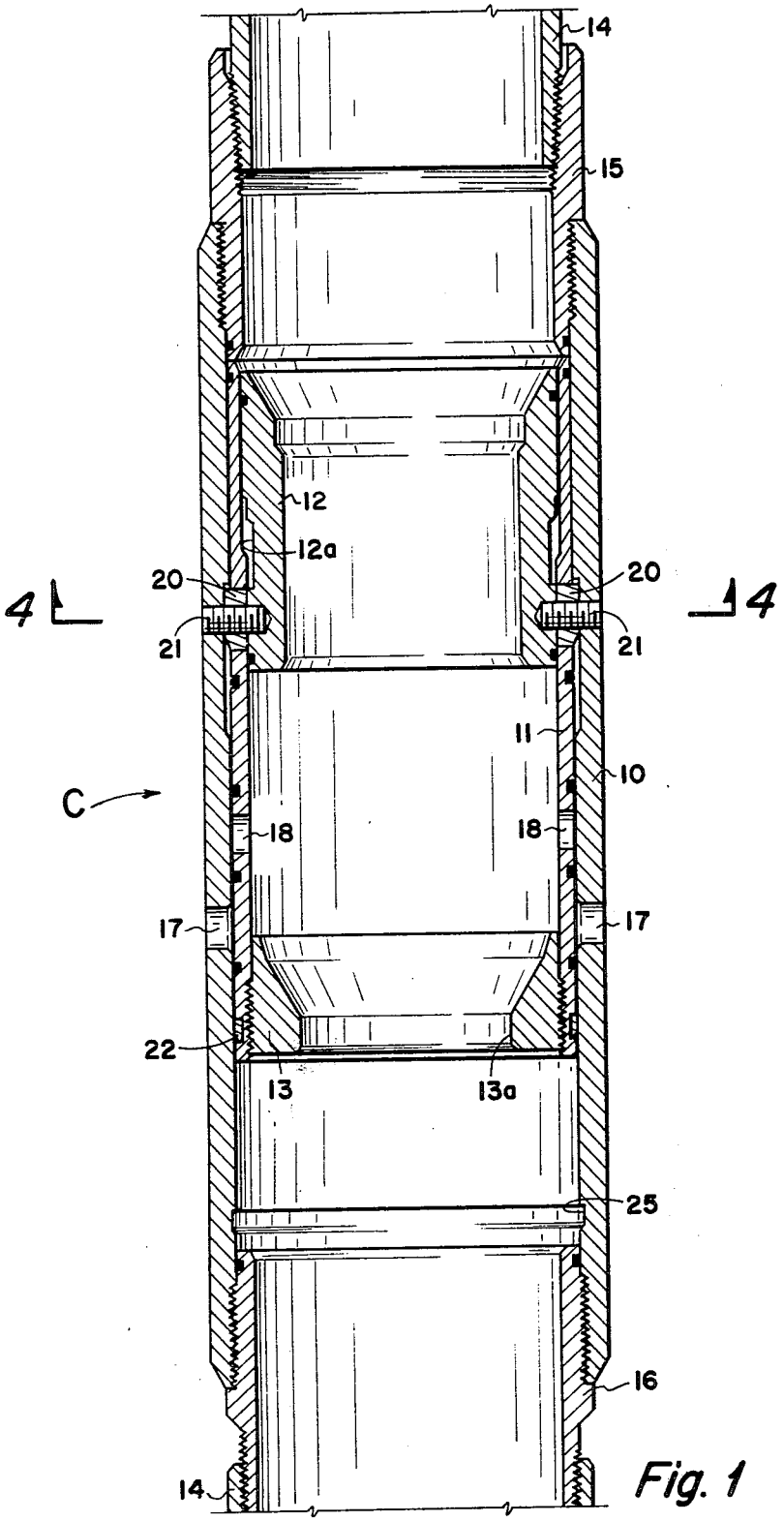
FIG. 1 is an elevation view, in section, of the collar assembly of this invention. The collar assembly is shown as it appears during the running-in position.

Referring to the drawing, the collar assembly of this invention is generally designated by the letter C. Basic parts of the collar assembly include a collar member 10, an outer sleeve 11, an inner sleeve 12 and a seat member 13. In the practice of this invention the collar 10 is connected into a well casing 14 at some point above the lower end of the casing. For example, at the top end collar 10 is connected into the well casing 14 by a top coupling 15 and at the bottom end by a similar coupling 16.

Ports 17 in collar 10 provide means for cement to flow into the borehole annulus (not shown) which surrounds the well casing 14. The outer sleeve 11 fits inside collar 10 and is designed to slide up and down in the collar. Sleeve 11 also includes ports 18. When the collar assembly is in the position illustrated in FIG. 2, the ports 17 and ports 18 are in direct alignment, to allow the passage of the cement from the collar assembly into the borehole annulus. The inner sleeve 12 fits inside the outer sleeve 11 at the top end and is moveable within sleeve 11. An external groove **12*a* is defined on the upper wall surface of sleeve 12**.

The outer sleeve 11 also includes lug members 20, which are inserted into the outer sleeve. Prior to the cementing operation, when the collar assembly is being run into the well casing 14, as illustrated in FIG. 1, the collar, the outer sleeve, and the inner sleeve are tied together by shear pins 21, which extend through each lug member. The seat member is defined by a ring 13, which threads into the bottom end of the outer sleeve 11. The seat portion of member 13 is defined by an inside shoulder **13*a*. An expandable ring 22 is carried in a groove on the outer wall surface of the outer sleeve 11**.

OPERATION

The invention can be illustrated by describing a typical cementing operation in which the collar assembly C is used. The first step is to run the collar assembly C into the well bore on the casing string 14. During the running-in step the outer sleeve 11 is held in its upper fixed position by the shear pins 21. In this position, as illustrated in FIG. 1 the ports 18 in sleeve 11 are above the ports 17 in collar 10, so that cement cannot flow into the annulus between the casing and the borehole. The primary cementing operation is then performed by pumping the cement slurry down through the "closed" collar assembly and into the annulus at the lower end of the casing string (not shown). A closing plug (not shown) is then dropped behind the primary cement charge to close off the casing string below the collar assembly C.

Figure 2:
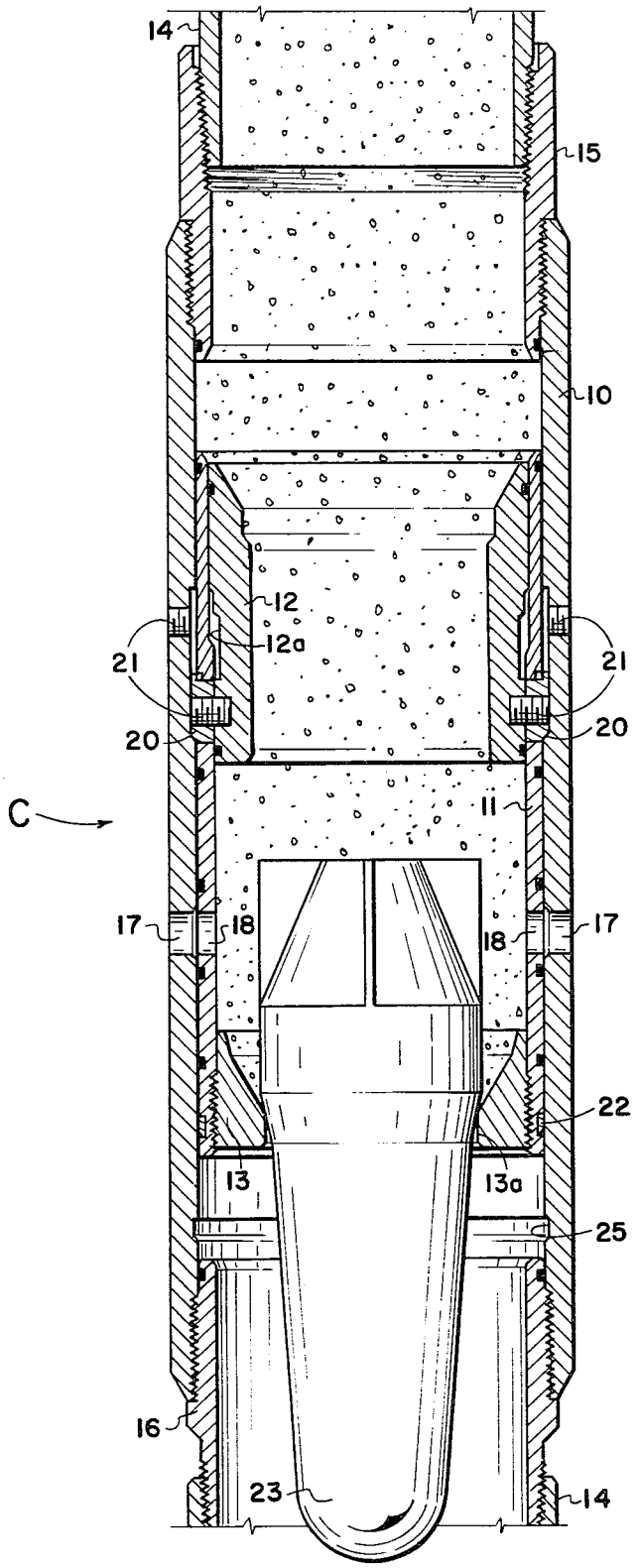
FIG. 2 is a similar elevation view, in section, which show the position of the collar assembly during a cementing operation.

The next step is to open the cementing ports in the collar assembly C, so that a secondary cementing job can be performed (note FIG. 2). This is done by dropping a weighted trip bomb 23 into the well casing 14. The bomb 23 passes through the inner sleeve 12 and seats itself firmly on the inside shoulder 13*a* of ring 13. As bomb 23 hits ring 13, the force behind the bomb shears pins 21 at the interface of the collar member 10 and lug members 20. This shearing action allows the outer sleeve 11 to move down to a point where a shoulder (tapered inwardly) on the bottom of each lug 20 seats against a matching shoulder (tapered outwardly) on the inner wall surface of collar 10. When sleeve 11 reaches this point the ports 18 are in direct alignment with the ports 17 in collar 10 so that cement can flow through the collar assembly into the borehole annulus.

Figure 3:
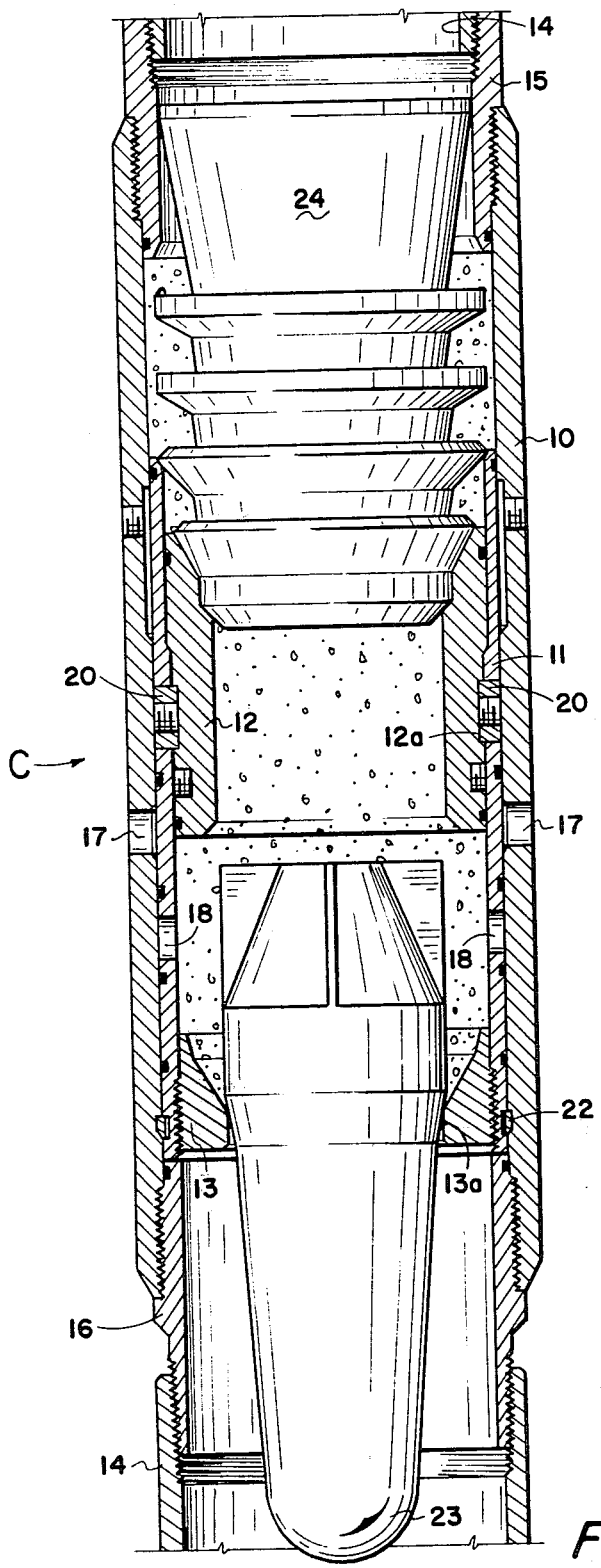
FIG. 3 is another elevation view, in section, illustrating the position of the collar assembly after the cementing operation is completed.

When the secondary cementing charge has been completely pumped through the collar assembly C, a closing plug 24 is inserted behind the cement column. Plug 24 is then pumped down through the casing by applying fluid pressure behind the plug. As shown in FIG. 3, when plug 24 reaches the collar assembly C it seats against a tapered shoulder at the top edge of the inner sleeve 12. A slight amount of additional fluid pressure is then applied against plug 24. This causes the pins 21 to shear a second time. This shearing action takes place at the interface of lugs 20 and the inner sleeve 12.

The force behind plug 24, which causes the pins 21 to shear a second time, also causes each of the lug members 20 to unseat from the shoulder on collar 10 and ride downwardly with the outer sleeve 11. At the same time, plug 24 moves the inner sleeve 12 downwardly until the shoulder (inwardly tapered), seats against a matching shoulder (outwardly tapered) on the outer shoulder 11. As sleeve 12 moves down, the external groove 12*a* on this sleeve moves into alignment with lugs 20, and each lug snaps solidly into the groove. The downward movement of sleeve 11 also allows the expandable ring 22 to push outwardly and snap into an internal groove 25, which is defined on the inner wall surface of collar 10 (note FIG. 2). When the sleeves 11 and 12 are locked in the positions illustrated in FIG. 3, the ports 18 are below the ports 17, so that the collar assembly is in its "closed" position.

After cementing is completed, the inner parts of the collar assembly C must be drilled out to provide access for oil to flow into the casing 14 through the ports in collar 10. The specific parts removed by the drill are plug 24, the inner sleeve 12, the outer sleeve 11, the trip bomb 23, and the ring 13. During the drilling step both the outer sleeve 11 and inner sleeve 12 are held in a fixed position so that the sleeves will not stick to the drill bit and rotate within collar 10.

Figure 4:
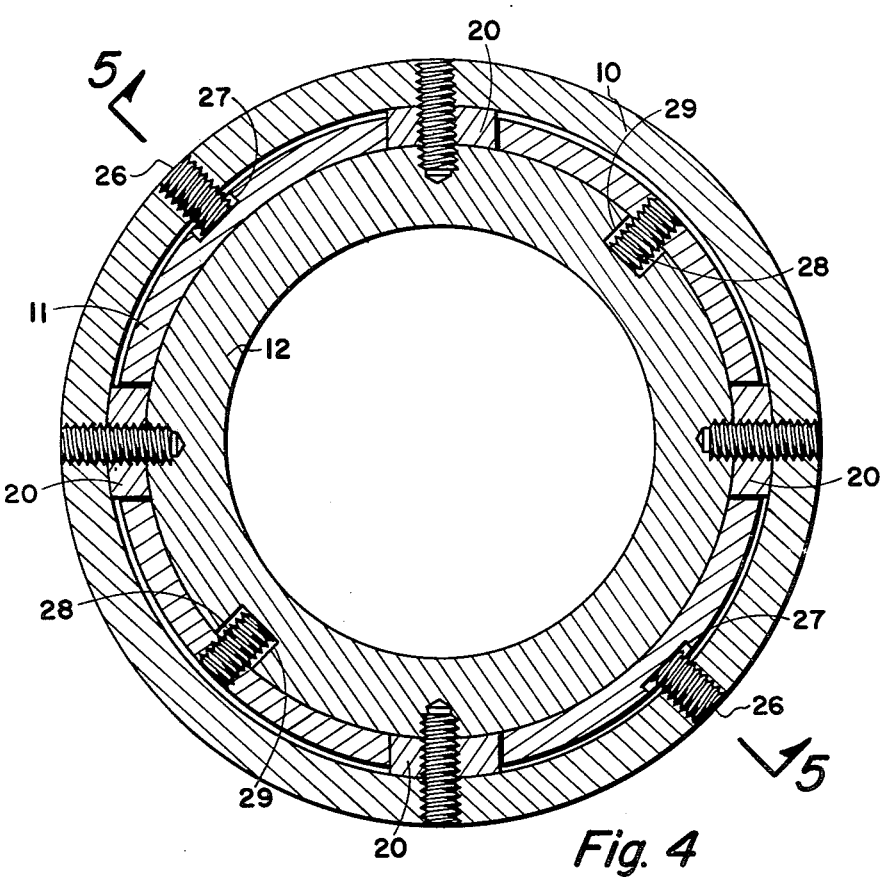
FIG. 4 is a cross-section view of the collar assembly, which is taken on line 4—4 of FIG. 1.
Figure 5:
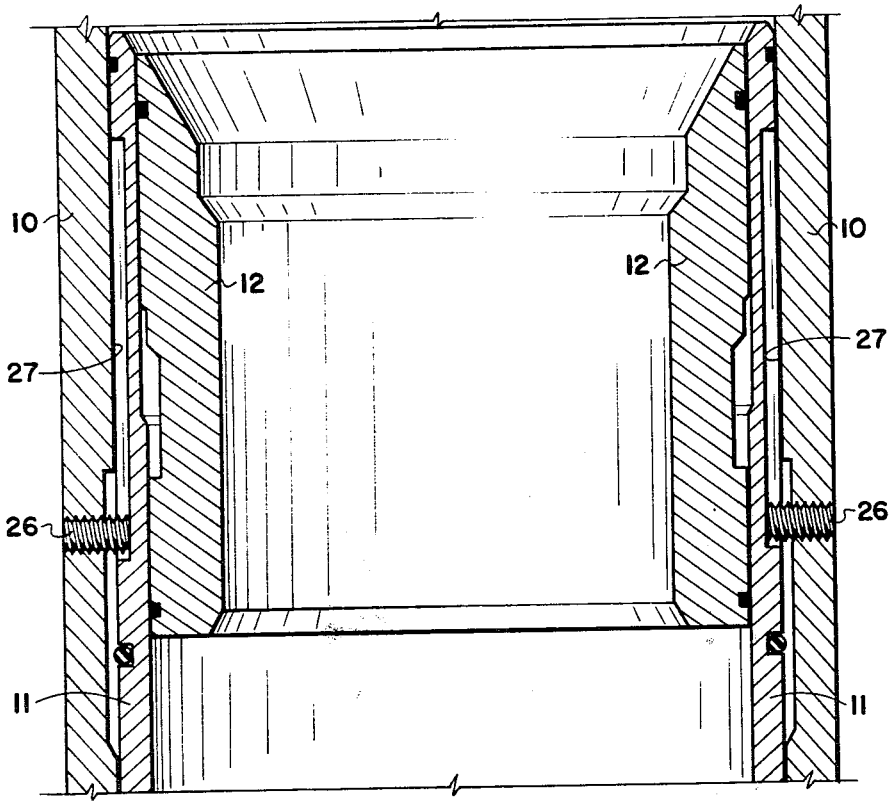
FIG. 5 is a vertical section view taken along line 5—5 of FIG. 4.

As shown in FIGS. 4 and 5, the outer sleeve 11 is prevented from rotating by a pair of guide screws 26. Referring specifically to FIG. 5, one end of each screw 26 is anchored in collar 10 and the opposite end of each screw is a free end. As sleeve 11 moves down to its closed position, the free end of each screw 26 rides in a vertical slot 27 on the outer wall surface of sleeve 11. The inner sleeve 12 is prevented from rotating by another pair of guide screws 28. As shown in FIG. 4, the screws 28 are each anchored at one end in the outer sleeve 11, and the opposite end is a free end, which rides in a vertical slot 29 in sleeve 12 as the sleeve moves down.

The invention claimed is:

1. A collar assembly for cementing a well casing in a borehole, the assembly comprising:

a collar member which connects into the well casing, and has at least one port in the collar wall;

an outer sleeve which is slidably positioned inside the collar, which has at least one port in the sleeve wall, which is movable within the collar member to a first position in which the collar port and outer sleeve port are in direct alignment, and which is further movable to a second position in which the outer sleeve port moves past the collar port;

a set of lug members inserted into the outer sleeve, each lug having a shoulder thereon adapted to seat against a corresponding shoulder defined on the inside wall surface of the collar member, when the outer sleeve moves to its first position;

an inner sleeve which is positioned inside the outer sleeve, and is movable within the outer sleeve;

a shear means which temporarily secures the outer sleeve to the collar member, and the inner sleeve to the outer sleeve;

a seat member which is positioned inside the outer sleeve, and is fastened to said outer sleeve;

the seat member being adapted to engage a weighted trip member, as the trip member is dropped through the inner sleeve, the trip member thereby causing the shear means to shear a first time, to allow the outer sleeve to move to its first position, such that cement can pass through the aligned ports into the borehole; and the inner sleeve having a top edge adapted to engage a plug member, as the plug member is dropped through the well casing, such that fluid pressure applied behind the plug member causes the shear means to shear a second time, to allow the outer sleeve to move further to its second position.

2. The collar assembly of claim 1 in which there is more than one port in the collar wall and more than one port in the outer sleeve wall.

3. The collar assembly of claim 1 which further comprises an expandable ring carried on the outside wall surface of the outer sleeve, said ring being adapted to expand outwardly and seat in a groove defined on the inside wall surface of the collar member, when the outer sleeve moves to its second positon.

4. The collar assembly of claim 1 in which the shear means is a set of shear pins, each pin being anchored in the collar member and extending through each lug member and into the inner sleeve.

5. The collar assembly of claim 1 in which the seat member is a ring having an inside shoulder defining a seat for engaging the weighted trip member.

6. The collar assembly of claim 1 which further comprises a first set of guide pins, each pin being anchored in the collar member, and each pin having a free end which rides in a vertical slot in the outer sleeve.

7. The collar assembly of claim 6 which further includes a second set of guide pins, each pin being anchored in the outer sleeve, and each pin having a free end which rides in a vertical slot in the inner sleeve.

8. A collar assembly for cementing a well casing in a borehole, the assembly comprising:

a collar member which connects into the well casing, and has several port openings in the collar wall;

an outer sleeve which is slidably positioned inside the collar, which has several port openings in the sleeve wall, which is movable downwardly within the collar member to a first position in which the collar ports and outer sleeve ports are in direct alignment, and is further movable to a second position in which the outer sleeve ports move past the collar port;

a set of lug members inserted into the outer sleeve, each lug having a shoulder thereon adapted to seat against a corresponding shoulder defined on the inside wall surface of the collar member, when the outer sleeve moves to its first position;

an inner sleeve which is positioned inside the outer sleeve, and is movable downwardly within the outer sleeve;

a set of shear pins which temporarily secure the outer sleeve, and is fastened into said outer sleeve;

a ring member which is positioned inside the outer sleeve, and is fastened into said outer sleeve;

the ring member having an inside shoulder defining a seat for engaging a weighted trip bomb, as the trip bomb is dropped through the inner sleeve, the trip bomb thereby causing the shear pins to shear a first time, to allow the outer sleeve to move downwardly to its first position; and the inner sleeve having a top edge adapted to engage a plug member, as the plug member is dropped through the well casing, the plug member thereby causing the shear pins to shear a second time, to allow the outer sleeve to move further downwardly to its second osition.

* * * * *